US005731830A

United States Patent [19]

Masuda

[11] Patent Number: 5,731,830

[45] Date of Patent: Mar. 24, 1998

[54] ELECTROPHOTOGRAPHY RECORDING METHOD AND RECORDING APPARATUS USING THE METHOD

[75] Inventor: Shuzou Masuda, Kawasaki, Japan

[73] Assignee: Fujitsu Limited, Kawasaki, Japan

[21] Appl. No.: 275,460

[22] Filed: Jul. 15, 1994

[30] Foreign Application Priority Data

Sep. 14, 1993 [JP] Japan ..... 5-229184

[51] Int. Cl.[6] ..... G03G 15/04

[52] U.S. Cl. ..... 347/112; 347/129; 347/140; 347/156; 347/158

[58] Field of Search ..... 347/112, 29, 140, 347/156, 158, 151

[56] References Cited

U.S. PATENT DOCUMENTS

| | | | |
|---|---|---|---|
| 4,845,519 | 7/1989 | Fuse | 347/156 |
| 4,851,926 | 7/1989 | Ishikawa | 358/300 |
| 4,965,747 | 10/1990 | Ohtsuka et al. | 395/107 |
| 5,083,144 | 1/1992 | Altmann | 347/119 |
| 5,488,452 | 1/1996 | Iwama | 347/156 |

*Primary Examiner*—Benjamin R. Fuller
*Assistant Examiner*—Craig A. Hallacher
*Attorney, Agent, or Firm*—Armstrong, Westerman, Hattori, McLeland & Naughton

[57] ABSTRACT

An electrophotography recording method is adapted to a recording apparatus having a carriage which includes processing means for forming a latent image on an image bearing member that is rotatable about an axis parallel to a transport direction of a recording sheet by charging the image bearing member and for developing the latent image, where the carriage is successively moved for each 1 line region having a width corresponding to a width of the image bearing member in a main scanning direction which is perpendicular to the transport direction of the recording sheet so that a developed image on the image bearing member is transferred and thermally fixed on the recording sheet. The method include steps of (a) storing printing data related to each 1 line region when the carriage is in a standby state, (b) selecting data to be printed out of the printing data related to the 1 line region when the carriage makes a printing, (c) forming the latent image on the image bearing member based on the data selected by step (b), (d) repeating the processes starting from the process of forming the latent image on the image bearing member up to the process of fixing the image on the recording sheet for each data selected by the step (b) in the 1 line region, and (e) repeating at least the steps (b) through (d) for all of line regions in one page of the recording sheet.

14 Claims, 10 Drawing Sheets n
m
n DOTS
m LINES
a11 a21
an1
a12 a22
an2
a1m
anm
TRANSPORT DIRECTION
20

ELECTROPHOTOGRAPHY RECORDING METHOD AND RECORDING APPARATUS USING THE METHOD

BACKGROUND OF THE INVENTION

The present invention generally relates to electrophotography recording methods and recording apparatuses, and more particularly to an electrophotography recording method which carries out printing a toner image of a recording drum onto a recording sheet and to a recording apparatus using such a recording method.

Recently, it has become more popular for recording apparatuses which carry out a recording, that is, print on a recording sheet, to employ the electrophotography technique. According to the electrophotography technique, a toner image is formed on a recording drum, and this toner image is transferred and fixed onto the recording sheet. There are demands to realize such recording apparatuses for personal use and the like. For this reason, there are demands to realize an inexpensive and compact recording apparatus which employs the electrophotography technique, and in addition, there are demands to carry out the printing at a high speed with a high quality.

FIG. 1 shows the construction of a conceivable electrophotography recording apparatus. An electrophotography recording apparatus 10 shown in FIG. 1 includes a charger part 12, an optical scanner part 13, a developer part 14, a transfer part 15, a discharge part 16, a cleaner 17, a fixing part 18 and paper transport parts 19*a* and 19*b* which are arranged in a periphery of a photosensitive drum (recording drum) 11. In addition, a predetermined number of paper supply parts 21*a* and 21*b* which accommodate recording sheets 20 are provided on one end of the recording apparatus 10. A stacker 22 for stacking ejected recording sheets 20 is provided on the other end of the recording apparatus 10.

The photosensitive drum 11 has a width at least corresponding to the width of the recording sheet 20. A rotation axis 11*a* of this photosensitive drum 11 is perpendicular to a paper transport direction. A toner 14*a* fills the developer part 14, and a developing roller 14*b* makes contact with the photosensitive drum 11 to form a toner image thereon. In addition, the fixing part 18 is made up of 2 fixing rollers 18*a* and 18*b*, and a heat source 23 is provided within the fixing roller 18*b*.

In this recording apparatus 10, the photosensitive drum 11 is uniformly charged by the charger part 12. A light emitting diode (LED) 13*a* of the optical scanner part 13 is irradiated on the photosensitive drum 11, so that a latent image of image information is recorded in the form of potential. The latent image on the photosensitive drum 11 is visualized into a toner image by adhering the toner 14*a*.

On the other hand, the recording sheet 20 is transported between the photosensitive drum 11 and the transfer part 15 by the transport rollers 19*a* and 19*b*, and the transported recording sheet 20 makes contact with the surface of the photosensitive drum 11. Hence, the toner image on the photosensitive drum 11 is transferred onto the transported recording sheet 20 by the transfer part 15, and is fixed by the fixing part 18. More particularly, the recording sheet 20 carrying the toner image, is pinched between the fixing roller 18*a* of the fixing part 18 and the fixing roller 18*b* which is heated to a predetermined temperature by the heat source 23, so that the toner image is thermally fixed on the recording sheet 20.

FIG. 2 is a diagram for explaining a recording system employed by the recording apparatus 10 shown in FIG. 1.

More particularly, FIG. 2 shows the recording system of the photosensitive drum 11 with respect to the recording sheet 20. It is assumed that the recording of pixels is made using n dots ($a_1$ through $a_n$) in the horizontal direction taken along the width of the transported recording sheet 20 and m lines ($a_{11}$ through $a_{1m}$) in the vertical direction.

In other words, data amounting to 1 page of the recording sheet 20 are transferred from an external equipment (not shown), and the photosensitive drum 11 successively prints on the recording sheet 20 a first line ($a_{11}$ through $1_{n1}$), a second line ($a_{12}$ through $1_{n2}$), . . . , and a mth line ($a_{1m}$ through $a_{nm}$).

In this case, because the potential on the photosensitive drum 11 disappears within a slight time, it is impossible to stop the above described process during the printing. Hence, the data amounting to 1 page are stored in one operation, and the data transfer to the optical scanner part 13 is made for the data of each line.

However, because the photosensitive drum 11 cannot be stopped during the printing, the memory capacity required to store all of the data amounting to 1 page of the recording sheet 20 in one operation becomes large. As a result, there are problems in that a memory (not shown) for storing the data becomes large and bulky, and that it is difficult to increase the printing speed.

On the other hand, when making the printing, the data transfer to the LED 13*a* amounts to at least the width of the recording sheet, and it takes time to make the data transfer for each line. Hence, the time required for the data transfer occupies a large portion of the printing time required to print 1 line, and the selectable width (or range) of the exposure time becomes narrow. Consequently, there are problems in that the tone adjustment becomes severe and the printing quality becomes poor.

Furthermore, since the optical scanning direction of the optical scanner part 13 is only in the direction perpendicular to the transport direction of the recording sheet 20, it becomes necessary for the photosensitive drum 11 and the like to have a width greater than or equal to the width of the recording sheet 20. As a result, there are also problems in that it is difficult to reduce both the size and cost of the recording apparatus 10.

SUMMARY OF THE INVENTION

Accordingly, it is a general object of the present invention to provide a novel and useful electrophotography recording method and recording apparatus using the method, in which the problems described above are eliminated.

Another and more specific object of the present invention is to provide an electrophotography recording method adapted to a recording apparatus having a carriage which is provided with processing means for forming a latent image on an image bearing member that is rotatable about an axis parallel to a transport direction of a recording sheet by charging the image bearing member and for developing the latent image, where the carriage is successively moved for each 1 line region having a width corresponding to a width of the image bearing member in a main scanning direction which is perpendicular to the transport direction of the recording sheet so that a developed image on the image bearing member is transferred and thermally fixed on the recording sheet, and the electrophotography recording method comprises the steps of (a) storing printing data related to each 1 line region transferred from outside the recording apparatus into storage means when the carriage is in a standby state at a print startable position on the recording sheet or while the carriage returns to the print startable position after printing, (b) selecting data to be printed out of the printing data related to the 1 line region and stored in the storage means when the carriage makes a printing on the recording sheet, (c) forming the latent image on the image bearing member by charging based on the data selected by the step (b) and making the developing, transferring and thermal fixing processes, (d) repeating the processes starting from the process of forming the latent image on the image bearing member up to the process of fixing the image on the recording sheet for each data selected by the step (b) in the 1 line region, and (e) repeating at least the steps (b) through (d) for all of line regions in one page of the recording sheet. According to the electrophotography recording method of the present invention, the carriage is moved in the main scanning direction with respect to the recording sheet and the printing is made from the same direction for each 1 line region, and the carriage is then returned to the print startable position. The printing data related to each 1 line region and transferred during non-operation of the processing means are stored in the storage means, and the printing is made by selecting the data to be printed out of the printing data stored in the storage means. Such a printing is made for 1 line region, and similarly made for each of the line regions on the recording sheet. As a result, it is possible to reduce the size of the recording apparatus, and also improve the printing speed and quality of the printed image.

Still another object of the present invention is to provide an electrophotography recording method comprising the steps of (a) storing printing data related to at least 1 line region into a memory during a time in which no printing is made, (b) selecting data to be printed out of the printing data stored in the memory, (c) forming an electrostatic latent image on an image bearing member based on the data selected by the step (b), where the image bearing member is rotatable about an axis parallel to a transport direction of a recording sheet, (d) developing the electrostatic latent image by processing means, transferring a developed image on the recording sheet, and fixing a transferred image on the recording sheet, (e) repeating the steps (b) through (d) for 1 line region, and (f) repeating the steps (b) through (e) for all line regions on one page of the recording sheet by successively moving processing means for each 1 line region having a width corresponding to a width of the image bearing member in a main scanning direction perpendicular to the transport direction of the recording sheet. According to the electrophotography recording method of the present invention, it is possible to reduce the size of the recording apparatus, and also improve the printing speed and quality of the printed image.

A further object of the present invention is to provide an electrophotography recording apparatus comprising a carriage including processing means for forming a latent image on an image bearing member that is rotatable about an axis parallel to a transport direction of a recording sheet by charging the image bearing member and for developing the latent image, moving means for successively moving the carriage for each 1 line region having a width corresponding to a width of the image bearing member in a main scanning direction which is perpendicular to the transport direction of the recording sheet, transfer means for transferring a developed image on the image bearing member onto the recording sheet, fixing means for thermally fixing a transferred image on the recording sheet, storage means for storing printing data related to at least 1 line region during a time in which no printing is made, selecting means for selecting data to be printed out of the printing data stored in the storage means, and control means for controlling a supply of the data from the selecting means to the processing means, where the width of the image bearing member is narrower than the width of a maximum size of the recording sheet used. According to the electrophotography recording apparatus of the present invention, it is possible to reduce the size of the recording apparatus, and also improve the printing speed and quality of the printed image.

Other objects and further features of the present invention will be apparent from the following detailed description when read in conjunction with the accompanying drawings.

DESCRIPTION OF THE PREFERRED EMBODIMENTS

First, a description will be given of the operating principle of the present invention, by referring to FIG. 3.

In the present invention, a carriage is at least provided with a processing means for forming a latent image on a rotary image bearing member which has a rotation axis parallel to a transport direction of a recording sheet which is transported by charging, and for developing the latent image by a printing member. This carriage is successively moved in a main scanning direction which is perpendicular to the transport direction of the recording sheet, for each 1 line region having a width of the image bearing member. The developed image on the image bearing member is transferred onto the recording sheet by a transfer means, and the transferred image is thermally fixed.

Figure 1:
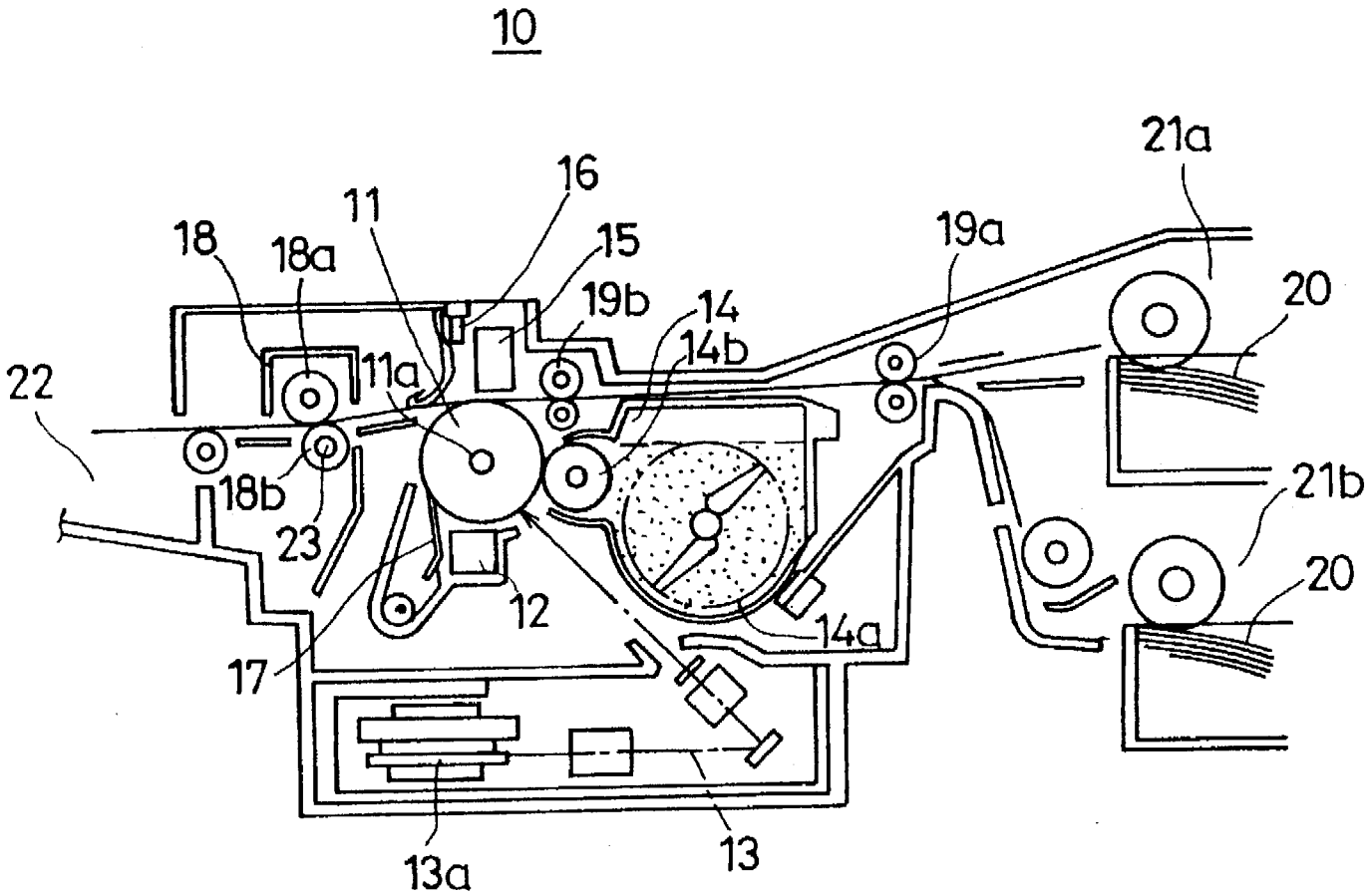
FIG. 1 is a cross sectional view showing the construction of a conceivable electrophotography recording apparatus.
Figure 2:
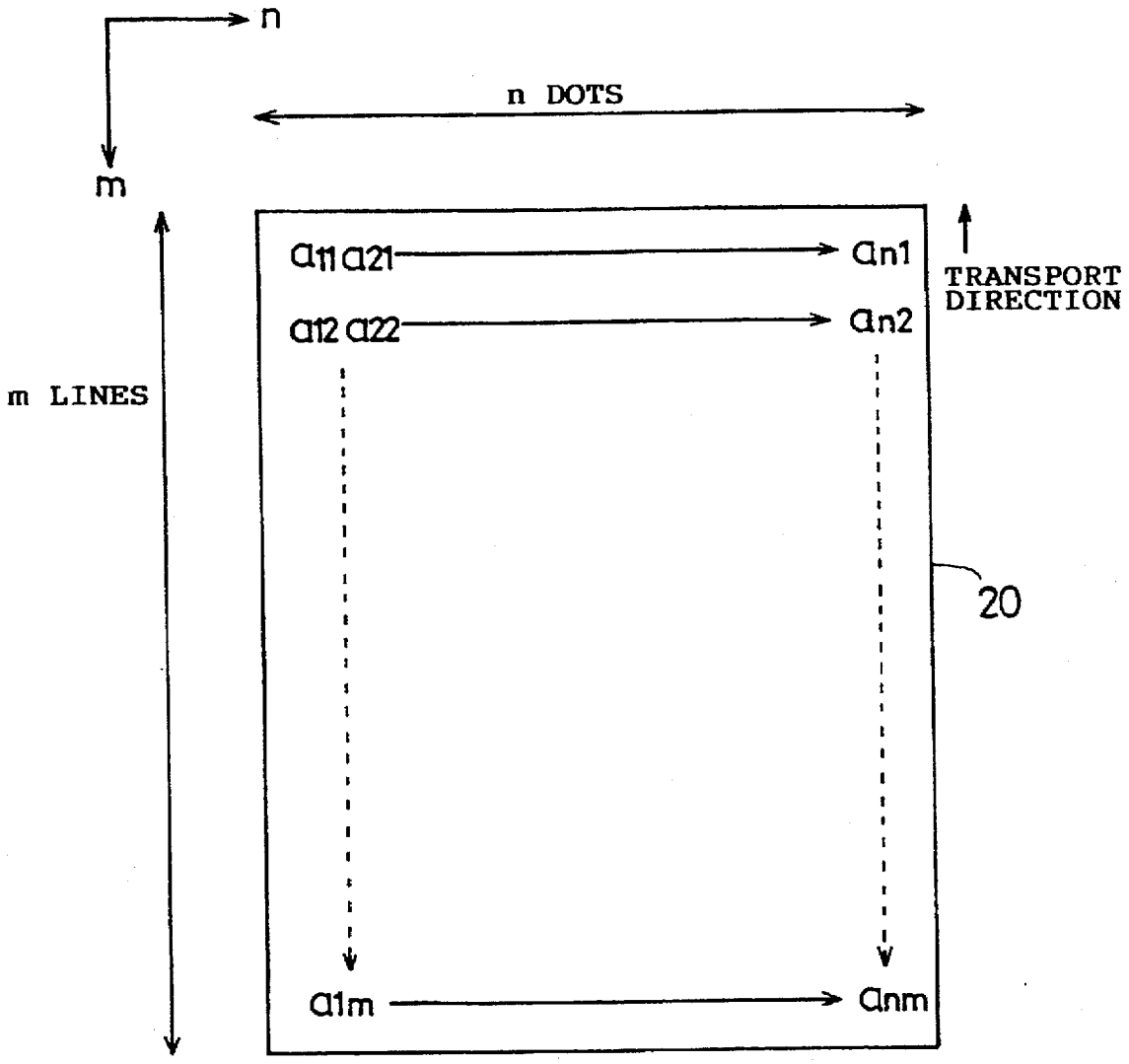
FIG. 2 is a diagram for explaining the recording system of the recording apparatus shown in FIG. 1.
Figure 3:
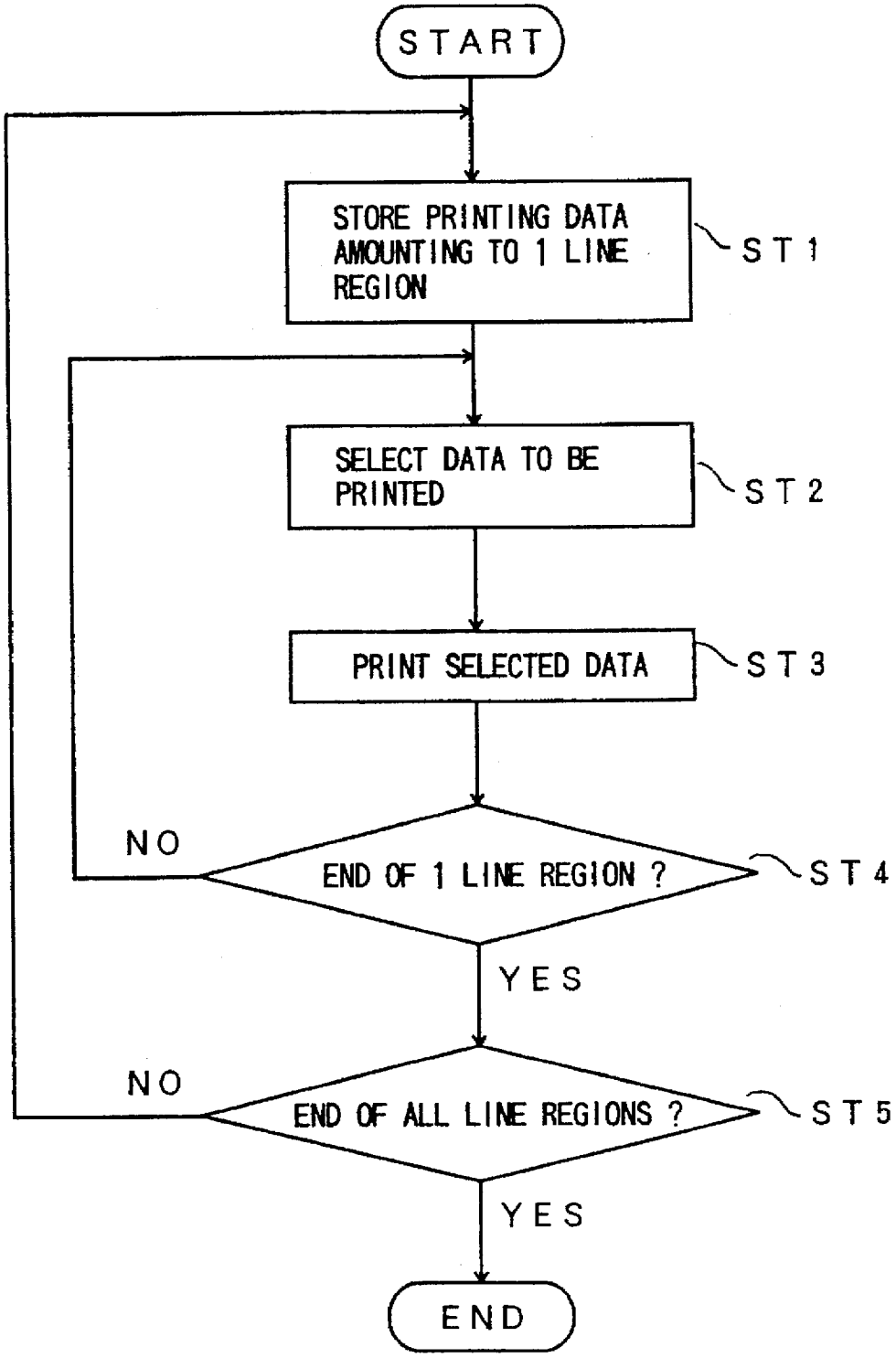
FIG. 3 is a flow chart for explaining the operating principle of the present invention.

First, a step ST1 shown in FIG. 3 stores in a storage means printing data for each 1 line region and transferred from the outside, when the carriage is in a standby state at a print startable position on the recording sheet or, when the carriage returns to the print startable position after the printing.

Next, a step ST2 selects the data to be printed out of the printing data related to each 1 line region and stored in the storage means, when the carriage makes the printing on the recording sheet.

Then, a step ST3 forms the latent image on the image bearing member based on the selected data, and carries out the developing, transfer and thermal fixing processes.

A step ST4 decides whether or not the processes starting from the process of forming the latent image on the image bearing member up to the process of thermally fixing the image for the 1 line region have ended. The process returns to the step ST2 if the decision result in the step ST4 is NO, but the process advances to a step ST5 if the decision result in the step ST4 is YES. Hence, the processes starting from the process of forming the latent image on the image bearing member up to the process of thermally fixing the image for the 1 line region are repeated for each selected data.

The step ST5 decides whether or not the above described processes have ended for all of the line regions. The process returns to the step ST1 if the decision result in the step ST5 is NO, but the process ends if the decision result in the step ST5 is YES. As a result, the processes starting from the process of forming the latent image on the image bearing member up to the process of thermally fixing the image are carried out for each 1 line region and repeated for all of the line regions.

Accordingly, in the present invention, the carriage is moved in the main scanning direction and the printing with respect to the recording sheet is made from the same direction for each line region, and the carriage is returned to the print startable position. The printing data for each 1 line that are transferred while the processing means is not making the printing operation are stored in the storage means, and the printing is made by selecting the data to be printed out of the data stored in the storage means. Such an operation is carried out for 1 line region, and is similarly repeated for all of the line regions.

Therefore, compared to the case where the printing data for the entire recording sheet are stored, it becomes sufficient to use as the storage means a memory or the like having a relatively small memory capacity. In addition, it is possible to make the width of the image bearing member narrower than the width of the recording sheet, thereby making it possible to reduce the size of the recording apparatus. In other words, the width of the image bearing member may be narrower than the width of a maximum size of the recording sheet which may be used on the recording apparatus.

On the other hand, since the printing data need only be transferred in units of 1 line, it is possible to carry out the data transfer at a high speed and to increase the printing speed. Moreover, it is possible to obtain a wide adjusting width for the time it takes to charge the image bearing member for each 1 line, and as a result, the adjustment of the printing density is facilitated and an image of a high quality can be printed.

Figure 4:
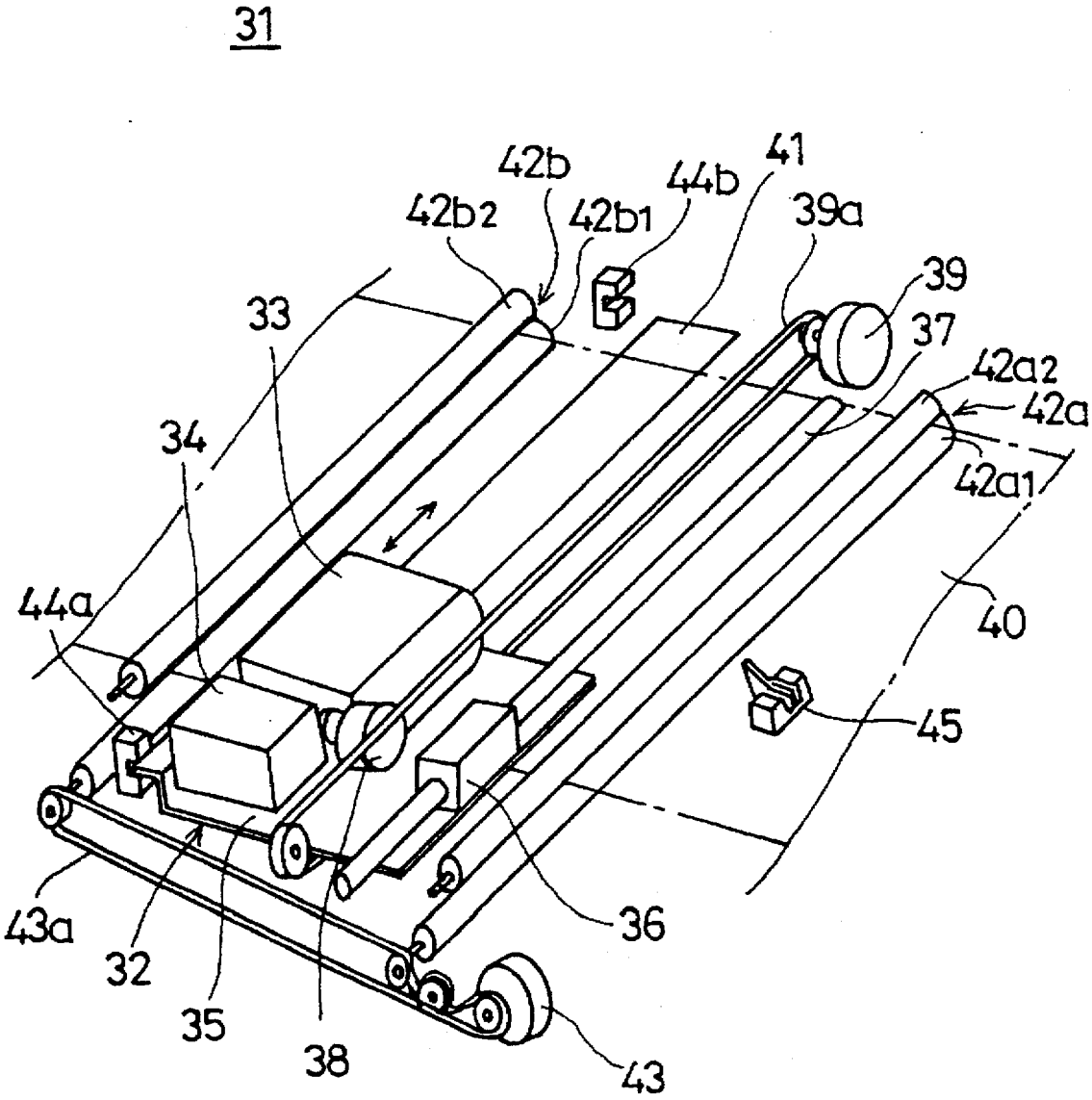
FIG. 4 is a perspective view generally showing an important part of an embodiment of a recording apparatus according to the present invention.

FIG. 4 generally shows an important part of an embodiment of a recording apparatus according to the present invention. In this embodiment, the present invention is applied to an electrophotography printer.

In a printer 31 shown in FIG. 4, a carriage 32 is provided on a holder 35 with openings (not shown) of a processing part 33 and a fixing unit 34 of a fixing means respectively for printing and fixing facing downwards in FIG. 4. A guide part 36 is provided on this holder 35, and the holder 35 is guided by the guide part 36 which engages a shaft 37. A process motor 38 for rotating a recording drum within the processing part 33 and a fixing roller within the fixing unit 34 is provided on the holder 35.

The carriage 32 is moved in a main scanning direction indicated by an arrow by a moving means formed by a carrier motor 39 and a belt 39*a*. This main scanning direction is perpendicular to a transport direction of a recording sheet 40. Of course, the recording sheet 40 is not limited to paper, and it is possible to use any kind of material suitable for printing an image thereof.

A transfer unit (printing platen) 41 is provided as a transfer means. This transfer unit 41 is arranged below the carriage 32 so as to confront the carriage 32. For example, this transfer unit 41 includes a substrate made of aluminum or the like, and a heat-resistant conductive member provided on the substrate on the side facing the carriage 32. For example, the heat-resistant conductive member may be silicon rubber having a conductive material mixed therein.

On the other hand, 2 pairs of transport rollers 42*a* and 42*b*, namely, a pair of transport rollers 42*a*1 and 42*a*2 and a pair of transport rollers 42*b*1 and 42*b*2, are arranged on both sides of the carriage 32. These pairs of transport rollers 42*a* and 42*b* extend in an axial direction which is the same as the main scanning direction, and are rotationally driven by a transport motor 43 via a belt 43*a*. The transport rollers 42*a* and 42*b*, the transport motor 43 and the belt 43*a* form a transport means. In other words, the recording sheet 40 is pinched between the pairs of transport rollers 42*a* and 42*b* and is transported by the rotational forces of the transport rollers 42*a* and 42*b*. This recording sheet 40 is positioned between the transfer unit 41 and the carriage 32.

In addition, first and second sensors 44*a* and 44*b* made up of photosensors or the like are arranged on both ends along the moving direction of the carriage 32. The first and second sensors 44*a* and 44*b* detect the position of the holder 35, so that a moving range of the carriage 32 can be restricted based on outputs of the first and second sensors 44*a* and 44*b*. A paper sensor 45 detects a leading edge and a trailing edge of the recording sheet 40.

Figure 5A:
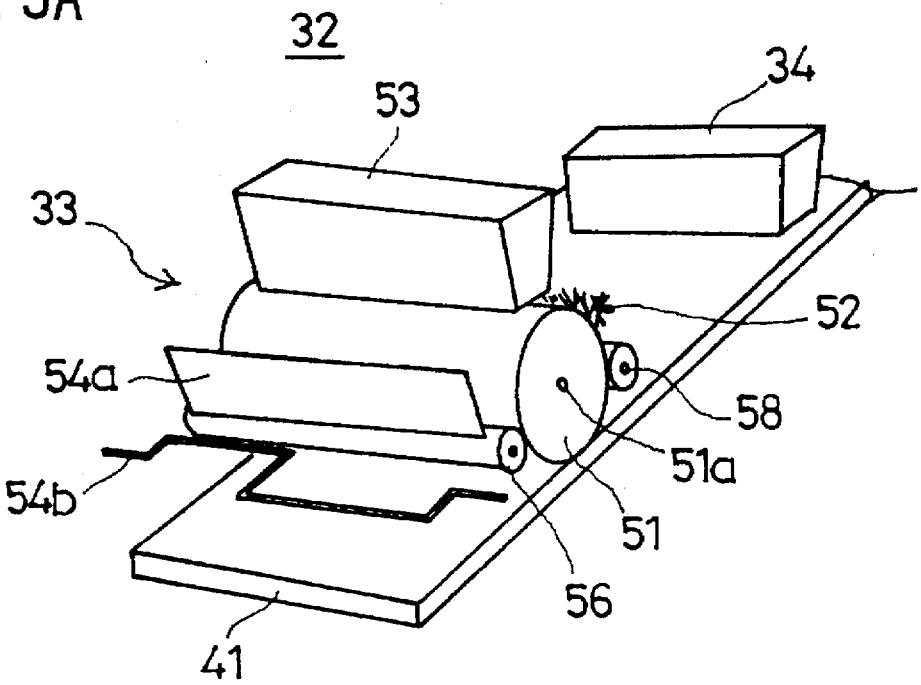
FIGS. 5A and 5B respectively are a perspective view and a cross sectional view generally showing the construction of a carriage shown in FIG. 4.
Figure 5B:
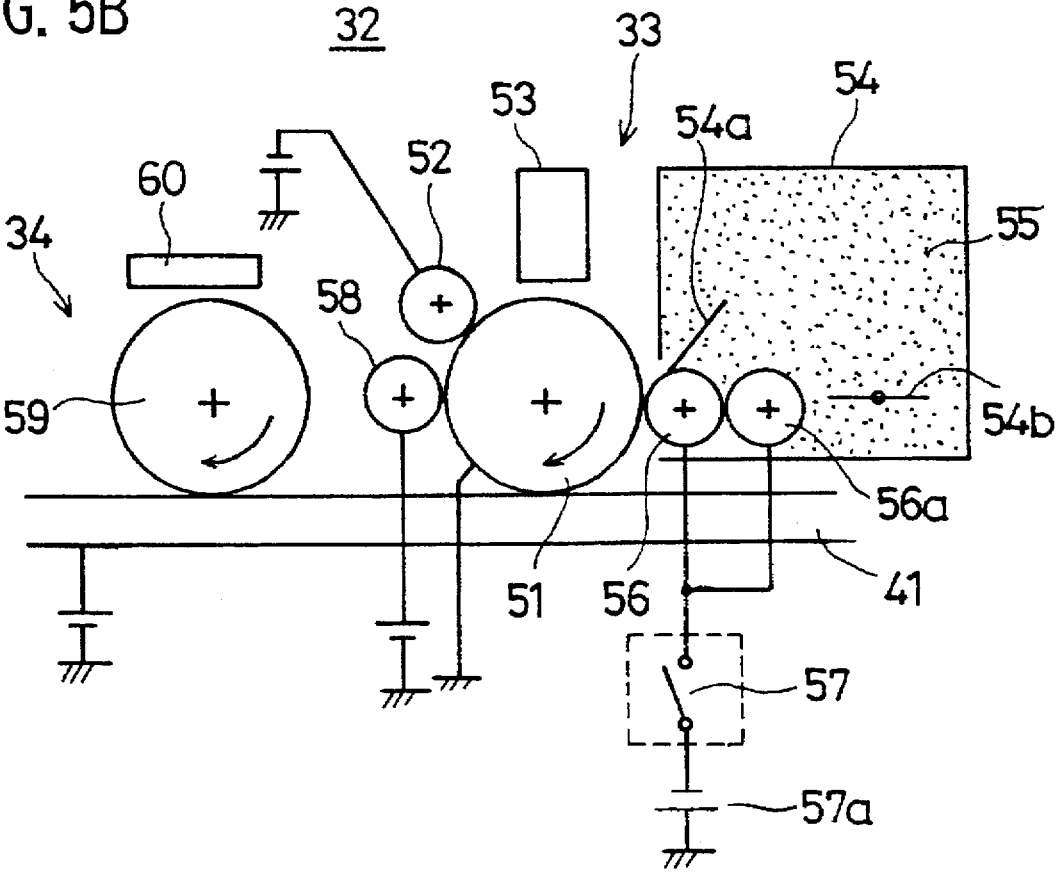

FIGS. 5A and 5B show the construction of the carriage 32 shown in FIG. 4. FIG. 5A generally shows a perspective view of the carriage 32, and FIG. 5B generally shows a cross-sectional side view of the carriage 32. In FIGS. 5A and 5B, the carriage 32 includes the processing part 33 and the fixing unit 34 as described above. The processing part 33 includes a recording drum 51 having a rotary axis 51*a* which is parallel to the transport direction of the recording sheet 40. The recording drum 51 is used as the image bearing member and is grounded. The recording drum 51 rotates on the recording sheet 40 which is placed on the transfer unit 41 at a peripheral speed synchronized to the movement of the carriage 32.

The surface of the recording drum 51 is uniformly charged by a charger 52 which is applied with a negative voltage, and an electrostatic latent image is formed on the surface of the recording drum 51 by an exposure unit 53. Although not shown in FIGS. 5A and 5B, the exposure unit 53 includes a LED 53*a* and a LED driver 53*b* for driving the LED 53*a*, for example, as will be described later in conjunction with FIG. 7.

The electrostatic latent image is visualized into a toner image by a toner 55 accommodated within a developer unit 54 and a developing roller 56. A blade 54*a* which makes contact with the developing roller 56, an auxiliary roller 56*a*, and a paddle (agitator) 54*b* for mixing the toner 55 are provided within the developer unit 54 as shown in FIG. 5B.

In addition, the developing roller 56 and the auxiliary roller 56*a* are coupled to a power supply 57*a* via a switch 57, and the carriage 32 is coupled to the power supply 57*a* via the switch 57. Hence, a bias voltage is stopped from being applied to the carriage 32 by the action of the switch 57 while the carriage 32 is stationary, so as to prevent unwanted toner 55 from adhering on the recording drum 51.

The toner image which is formed on the grounded recording drum 51 is transferred onto the recording sheet 40 as a recording image when a predetermined voltage is applied across the recording drum 51 and the transfer unit 41 which confronts the recording drum 51 via the recording sheet 40 and is applied with a positive bias voltage. After the recording image is formed on the recording sheet 40, the residual toner 55 remaining on the recording drum 51 is removed by a cleaner 58 which is applied with a positive voltage.

On the other hand, the fixing unit 34 includes a fixing roller 59 which is provided as a fixing body. For example, the fixing roller 59 is made of a hollow cylindrical member made of a magnetic material and coated with teflon. This fixing roller 59 and the recording drum 51 and the developing roller 56 described above are rotated by the process motor 38 in synchronism with the movement of the carriage 32. A heater part 60 for heating the fixing roller 59 is provided in a vicinity of the fixing roller 59.

Figure 6:
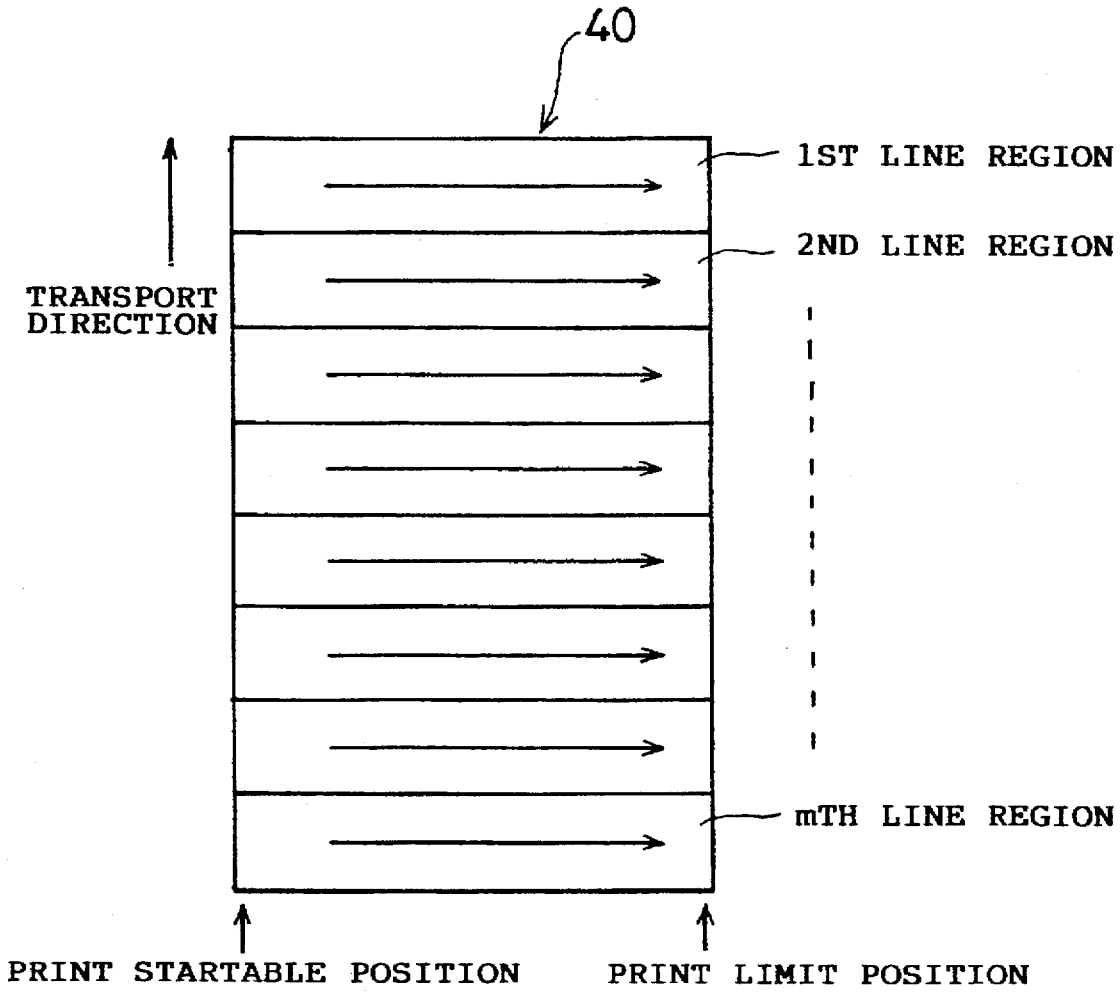
FIG. 6 is a diagram for explaining the recording operation of a carriage.

FIG. 6 is a diagram for explaining a recording operation of the carriage 32. Hence, the operation of the printer 51 will be described with reference to FIG. 6.

As shown in FIG. 6, with respect to the recording sheet 40 which is transported by the transport rollers 42*a* and 42*b*, the carriage 32 moves in the main scanning direction indicated by the arrow which is perpendicular to the transport direction of the recording sheet 40. In this case, the width of the recording drum 51 corresponds to 1 line with respect to the recording sheet 40, and the carriage 32 makes m scans from the first line region to the mth line region by undergoing reciprocal movements.

For the sake of convenience, it is assumed that the recording drum 51 of the carriage 32 is presently located at the print startable position at the left end of the first line on the recording sheet 40, and that this print startable position is detected by the first sensor 44*a*. In this state, when the recording sheet 40 is transported by the transport rollers 42*a* and 42*b* and the leading edge of the recording sheet 40 is detected by the paper sensor 45, the fixing roller 59 and the recording drum 51 of the carriage 32 are rotated by the process motor 38 in a going direction of the main scanning direction at a peripheral speed synchronized to the movement of the carriage 32. Thus, the recording drum 51 and the fixing roller 59 rotate and move on the recording sheet 40.

In this state, the processing part 38 forms the electrostatic latent image on the recording drum 51 based on the data. The developing roller 56 develops the electrostatic latent image, that is, visualizes the electrostatic latent image, into the toner image. The transfer unit 41 transfers the toner image on the recording sheet 40 to form the recorded image on the recording sheet 40. In addition, the fixing of the recorded image is made by the fixing roller 59 which is heated to a predetermined temperature by the heater part 60 within the fixing unit 34.

When the carriage 32 reaches the right end (print limit position) of the first line on the recording sheet 40, this position is detected by the second sensor 44*b* or, the carriage 32 returns to the print startable position described above from an intermediate print end position. When the printing of the first line ends, the transport rollers 42*a* and 42*b* transport the recording sheet 40 by an amount corresponding to 1 line, and the recording drum positioned above the print startable position of the second line. The printing of the second line through the nth line is successively made in a similar manner. The reception of the printing data and the recording method will be described in conjunction with FIG. 7 et seq.

Figure 7:
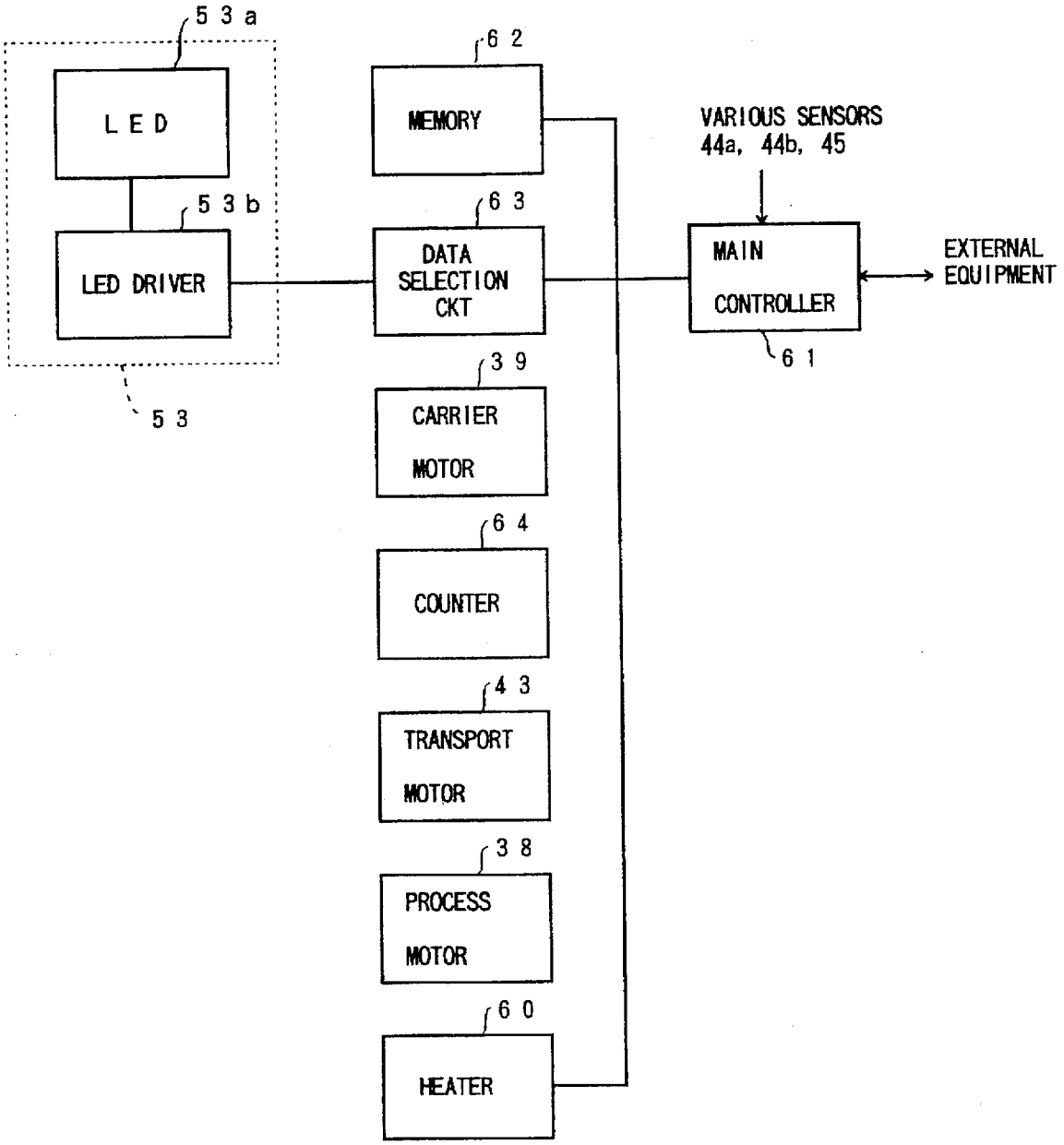
FIG. 7 is a system block diagram showing a control system of the embodiment shown in FIG. 4.

FIG. 7 is a system block diagram showing a control system of the embodiment shown in FIG. 4. The printer 31 includes a control system shown in FIG. 7 in addition to the printing mechanism shown in FIG. 4. The control system of the printer 31 shown in FIG. 7 generally includes a main controller 61, a memory 62, a data selection circuit 63 and a counter 64.

The main controller 61 controls and drives the carrier motor 39 for moving the carriage 32, the transport motor 43 for transporting the recording sheet 40, the process motor 38 for rotating the recording drum 51 and the fixing roller 59, and the heater part 60 which controls the temperature of the fixing roller 59, based on outputs of the various sensors 44*a*, 44*b*, 45 and the like. In addition, the main controller 61 is coupled to an external equipment (not shown), and stores the printing data transferred from the external equipment in the memory 62. The main controller 61 also supplies the data selected by the data selection circuit 63 to the LED driver 53*b* of the exposure unit 53, so that the light beam emitted from the LED 53*a* irradiates the recording drum 51 depending on the data.

Figure 8:
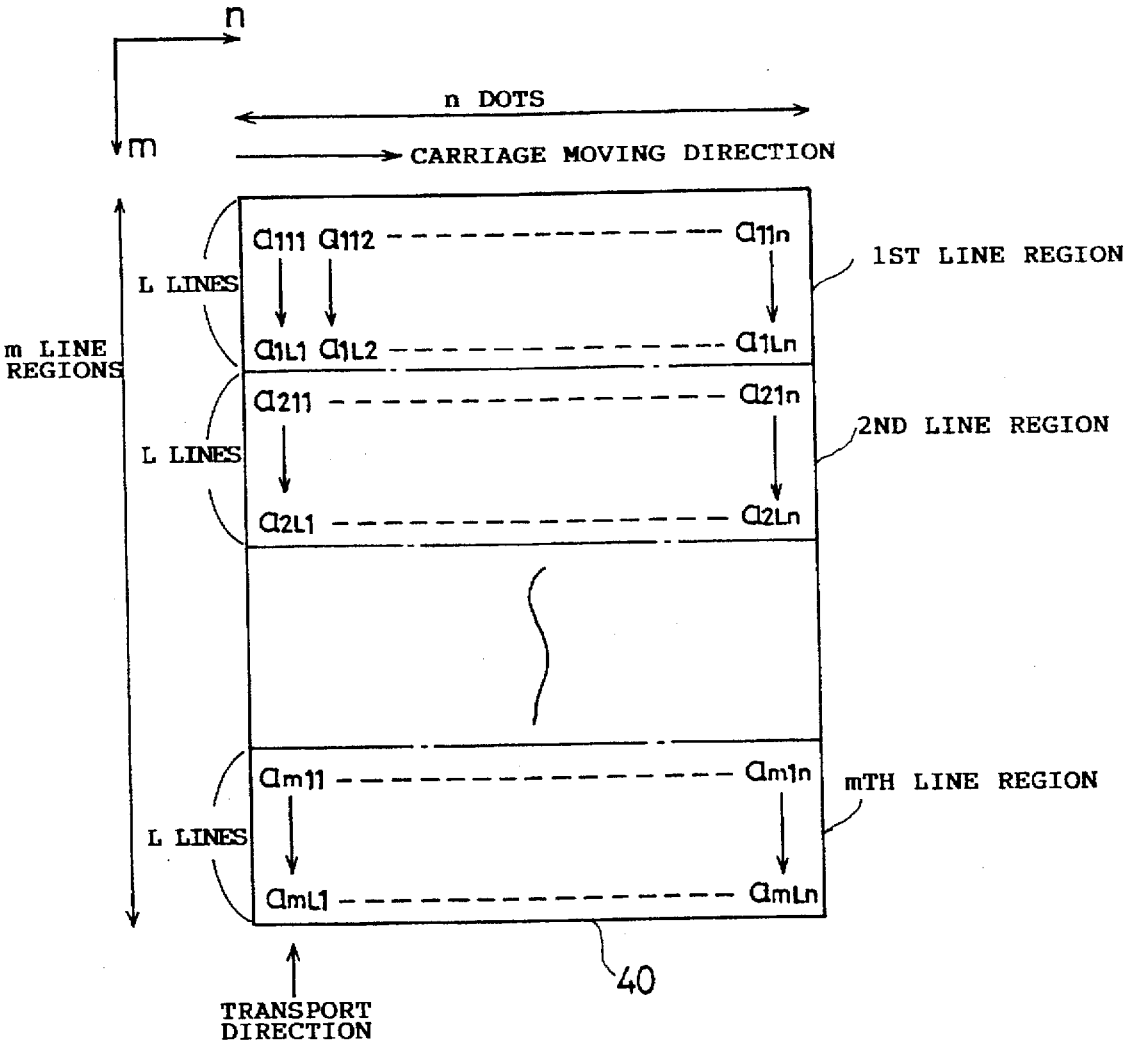
FIG. 8 is a diagram for explaining the recording method of the embodiment.

FIG. 8 is a diagram for explaining the recording method of the embodiment. In addition, FIG. 9 is a diagram for explaining a data processing shown in FIG. 8.

As shown in FIG. 8, the carriage 23 makes the printing on the recording sheet 40 using n dots in the main scanning direction in m line regions made up of the first line region through the mth line region along the transport direction of the recording sheet 40. In this case, L lines are printed in each line region, where L denotes the number of lines that can be printed within the width of the recording drum 51. In other words, the printing of the first line ($a_{111}$ through $a_{11n}$) through the Lth line ($a_{1L1}$ through $a_{1Ln}$) are made in the first line region, and the printing is similarly made up to the mth line region.

Figure 9:
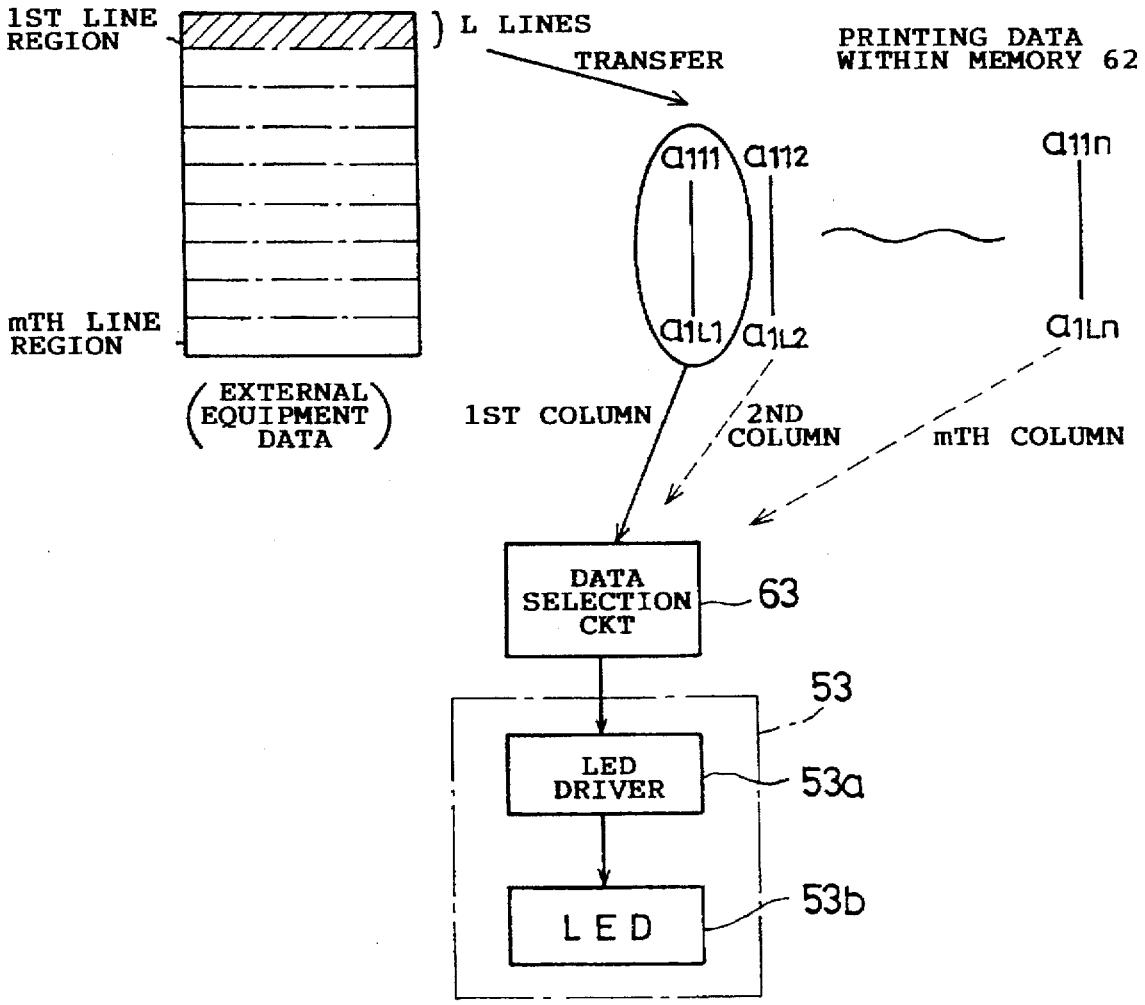
FIG. 9 is a diagram for explaining a data processing shown in FIG. 8.

When the carriage 32 is at the print startable position on the recording sheet 40 and before the printing is started, the printing data ($a_{111}$ through $a_{11n}$, . . . , $a_{1L1}$ through $a_{1Ln}$) of the first line region are first transferred from the external equipment to the main controller 61 and stored in the memory 62, as shown in FIG. 9. Out of the printing data stored in the memory 62, the data selection circuit 63 successively extracts the data in the direction taken along the width of the recording drum 51 (that is, the transport direction of the recording sheet 40) from the first column to the nth column. First, the data ($a_{111}$ through $a_{1Ln}$) in the first column are transferred to the LED driver 53*b* of the exposure unit 53. The LED driver 53*b* drives the LED 53*a* based on the data in the first column, and forms a corresponding latent image on the recording drum 51. The data in the second through the nth columns ($a_{11n}$ through $a_{1Ln}$) are successively transferred to the exposure unit 53 in a similar manner, in synchronism with the movement of the carriage 32.

As described above, the developing, transfer and thermal fixing of the printing operation are carried out by the carriage 32 with respect to the first line region, and the carriage 32 returns to the print startable position at the left end of the recording sheet 40 when the printing ends. In addition, the recording sheet 40 is transported by the transport rollers 42*a* and 42*b* by an amount corresponding to 1 line region. The printing data of the second line region are transferred from the external equipment to the main controller 61 while the carriage 32 returns to the print startable position, and the transferred printing data related to the second line region are stored in the memory 62. The printing of the second line region is made similarly as described above for the first line region. Thereafter, the printing is similarly made for the third through mth line regions.

Figure 10:
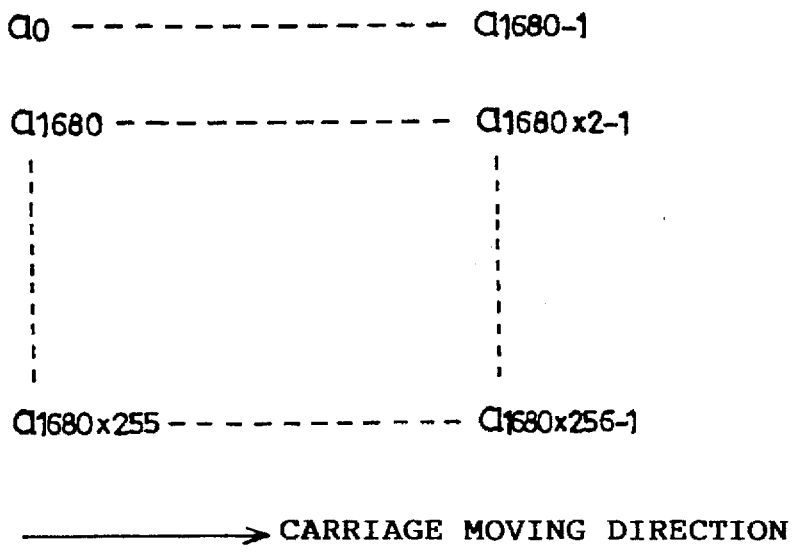
FIG. 10 is a diagram for explaining the operation of a data selection circuit shown in FIG. 7.

FIG. 10 is a diagram for explaining the operation of the data selection circuit 63 shown in FIG. 7. More particularly, FIG. 10 shows the printing data for a case where a printing is to be made on the recording sheet 40 having the A4 size with the width of 210 mm, for example, at a recording density of 8 dots/mm and 256 lines in 1 line region (for example, in the first line region). In other words, 1 line region has a width of 32 mm which means that there are 8 dots ×32=256 dots taken in the direction along the width of 1 line region. Accordingly, the printing of 256 lines amounting to the width of 32 mm is made by 210×8=1680 dots per line based on the data ($a_0$ through $a_{1680-1}$).

Figure 11:
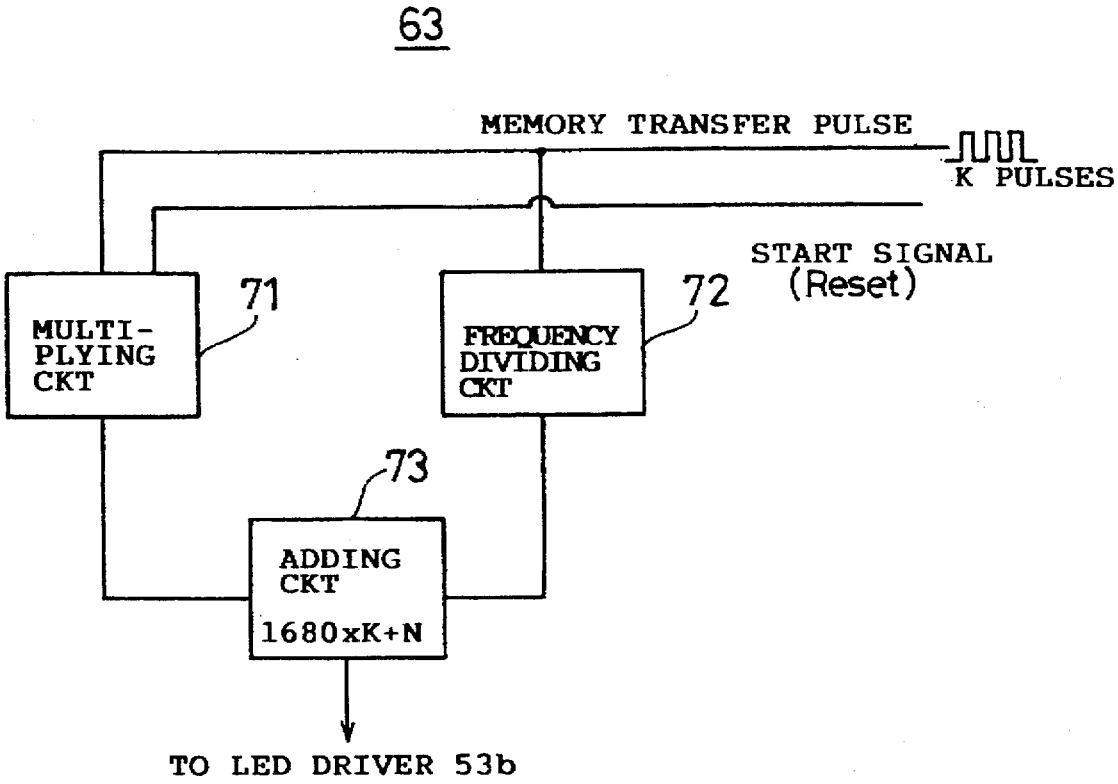
FIG. 11 is a system block diagram showing the construction of the data selection circuit shown in FIG. 7.

FIG. 11 shows the construction of the data selection circuit 63. The data selection circuit 63 shown in FIG. 11 includes a multiplying circuit 71, a frequency dividing circuit 72 and an adding circuit 73. K pulses from the memory 62 shown in FIG. 7 are input to the multiplying circuit 71 which multiplies 1680 to K (1680×K), and to the frequency dividing circuit 72 which divides K by 256 (K/256=N). In addition a start signal (or a reset signal) is input to the multiplier 71. A multiplied result (1680×K) from the multiplying circuit 71 and the divided result (K/256=N) from the frequency dividing circuit 72 are added in the adding circuit 73 which outputs an added result (1680×K+N). This added result (1680×K+N) is transferred to the LED driver **53*b*** as the data (for example, $a_0$, $a_{1680}$, . . . , $a_{1680.256}$) of each column.

Hence, the printing data to be stored in the memory 62 need only amount to 1 line region, and the printing data are stored in the memory 62 during a time in which the carriage 32 does not make the printing operation, that is, when the carriage 32 is in the standby state at the print startable position or while the carriage 32 is returning to the print startable position. As a result, it is possible to make the necessary data transfer at an extremely high speed, thereby enabling the printing speed to be increased.

In addition, since the printing data to be stored need only amount to 1 line region, it is unnecessary to make the width of the recording drum 51 greater than or equal to the width of the maximum size of the recording sheet 40 as required in the conceivable recording apparatus, and for this reason, it is possible to reduce the size of the recording apparatus.

Moreover, since the data transfer to the exposure unit 53 can be made at a high speed, it is possible to widen the adjusting width of the LED ON time for making the printing amounting to 1 line within 1 line region. Consequently, the adjustment of the printing density is facilitated, and a recorded image having a high quality can be obtained.

In the embodiment described above, it is of course possible to transfer from the external equipment the printing data amounting to two or more line regions and preferably less than the total number of line regions on 1 page of the recording sheet 40, provided that the memory capacity of the memory 62 is sufficient. In addition, if the printing data from the external equipment is given in the form of font data, it is possible to develop the font data into image data during a time when the operation of the processing part 33 is stopped. This developing of the font data into the image data may be carried out by a known means using the memory 62 under a control of the main controller 61, for example.

Further, the present invention is not limited to these embodiments, but various variations and modifications may be made without departing from the scope of the present invention.

What is claimed is:

1. An electrophotography recording method adapted to a recording apparatus having a carriage which is provided with a processing element and fixing element, said processing means forming a latent image on an image bearing member that is rotatable about an axis parallel to a transport direction of a recording sheet by charging the image bearing member and for developing the latent image, said carriage being successively moved for each 1 line region having a width corresponding to a width of the image bearing member in a main scanning direction which is perpendicular to the transport direction of the recording sheet, said fixing element being arranged adjacent said processing element at a position lagging said processing element in the main scanning direction on the carriage, so that a developed image on the image bearing member is transferred and thermally fixed on the recording sheet by said fixing element, said electrophotography recording method comprising the steps of:

(a) storing printing data related to each 1 line region transferred from outside the recording apparatus into a storage element when the carriage is in a standby state at a print startable position on the recording sheet or while the carriage returns to the print startable position after printing;

(b) selecting data to be printed out of the printing data related to the 1 line region and stored in the storage element when making a printing on the recording sheet;

(c) forming the latent image on the image bearing member by charging based on the data selected by said step (b) and making the developing, transferring and thermal fixing processes;

(d) repeating the processes starting from the process of forming the latent image on the image bearing member up to the process of fixing the image on the recording sheet for each data selected by said step (b) in the 1 line region; and (e) repeating at least said steps (b) through (d) for all of line regions in one page of the recording sheet.

2. The electrophotography recording method as claimed in claim 1, wherein said step (a) stores the printing data transferred from the outside in units of the printing data related to only 1 line region.

3. The electrophotography recording method as claimed in claim 1, wherein said step (a) stores the printing data transferred from the outside in units of the printing data related to an arbitrary number of line regions greater than one and less than a total number of line regions on one page of the recording sheet.

4. The electrophotography recording method as claimed in claim 1, which further comprises the step of (f) developing font data into image data when the printing data are given in a form of the font data.

5. The electrophotography recording method as claimed in claim 1, wherein the width of the image bearing member is narrower than the width of a maximum size of the recording sheet used on the recording apparatus.

6. An electrophotography recording method comprising the steps of:

(a) storing printing data related to at least 1 line region into a memory during a time in which no printing is made;

(b) selecting data to be printed out of the printing data stored in the memory;

(c) forming an electrostatic latent image on an image bearing member based on the data selected by said step (b), said image bearing member being rotatable about an axis parallel to a transport direction of a recording sheet;

(d) developing the electrostatic latent image by a processing element, transferring a developed image on the recording sheet, and fixing a transferred image on the recording sheet by a fixing element, (e) repeating said steps (b) through (d) for 1 line region; and (f) repeating said steps (b) through (e) for all line regions on one page of the recording sheet by successively moving a carriage for each 1 line region having a width corresponding to a width of the image bearing member in a main scanning direction which is perpendicular to the transport direction of the recording sheet, said carriage being provided with said processing element and said fixing element such that said fixing element is arranged adjacent to said processing element at a position lagging said processing element in the main scanning direction on the carriage.

7. The electrophotography recording method as claimed in claim 6, wherein said step (a) stores the printing data in units of the printing data related to only 1 line region.

8. The electrophotography recording method as claimed in claim 6, wherein said step (a) stores the printing data in units of the printing data related to an arbitrary number of line regions greater than one and less than a total number of line regions on one page of the recording sheet.

9. The electrophotography recording method as claimed in claim 6, which further comprises the step of (g) developing font data into image data when the printing data are given in a form of the font data.

10. The electrophotography recording method as claimed in claim 6, wherein the width of the image bearing member is narrower than the width of a maximum size of the recording sheet used.

11. An electrophotography recording apparatus comprising:

a carriage having provided thereon processing means for forming a latent image on an image bearing member that is rotable about an axis parallel to a transport direction of a recording sheet by charging the image bearing member and for developing the latent image;

moving means for successively moving said carriage for each 1 line region having a width corresponding to a width of the image bearing member in a main scanning direction which is perpendicular to the transport direction of the recording sheet;

transfer means for transferring a developed image on the image bearing member onto the recording sheet;

fixing means, provided adjacent to said processing means at a position lagging said processing means in the main scanning direction on said carriage, for thermally fixing a transferred image on the recording sheet;

storage means for storing printing data related to at least 1 line region during a time in which no printing is made;

selecting means for selecting data to be printed out of the printing data stored in said storage means; and control means for controlling a supply of the data from said selecting means to said processing means;

the width of the image bearing member being narrower than a width of a maximum size of the recording sheet used.

12. The electrophotography recording apparatus as claimed in claim 11, wherein said control means controls said storage means to store the printing data in units of the printing data related to only 1 line region.

13. The electrophotography recording apparatus as claimed in claim 11, wherein said control means controls said storage means to store the printing data in units of the printing data related to an arbitrary number of line regions greater than one and less than a total number of line regions on one page of the recording sheet.

14. The electrophotography recording apparatus as claimed in claim 11, which further comprises means for developing font data into image data when the printing data are given in a form of the font data.

* * * * *